United States Patent [19]

Sturgeon et al.

[11] 4,195,418

[45] Apr. 1, 1980

[54] ZONED HEAT TREATING APPARATUS

[75] Inventors: Lloyd F. Sturgeon, Oreland, Pa.; George M. Tice, Lexington, N.C.

[73] Assignee: SCM Corporation, New York, N.Y.

[21] Appl. No.: 943,327

[22] Filed: Sep. 18, 1978

[51] Int. Cl.[2] ..... F26B 25/06

[52] U.S. Cl. ..... 34/216; 34/155; 34/217

[58] Field of Search ..... 34/203, 209, 216, 217, 34/236, 151, 155, 157, 162; 432/128, 129, 86

[56] References Cited

U.S. PATENT DOCUMENTS

| | | | |
|---|---|---|---|
| 1,813,750 | 7/1931 | Mackenzie | 34/203 |
| 2,768,629 | 10/1956 | Maul | 34/203 |
| 3,812,599 | 5/1974 | Bruckner | 34/216 |
| 3,955,287 | 5/1976 | Brock et al. | 34/216 |
| 4,058,905 | 11/1977 | Knight | 34/216 X |

FOREIGN PATENT DOCUMENTS

| | | | |
|---|---|---|---|
| 632709 | 6/1936 | Fed. Rep. of Germany | 34/203 |

*Primary Examiner*—Edward G. Favors
*Attorney, Agent, or Firm*—Richard H. Thomas

[57] ABSTRACT

A heat treating apparatus particularly useful for the drying/heat-setting and cooling of synthetic tow comprises first and second elongated housings with separate conveyors longitudinally positioned in said housings, the housings being at different temperatures. Means are provided to deposit a continuous length of tow on the conveyor of the first housing in an undulating pattern to define a substantially straight bed of tow having substantially uniform maximum thickness and width dimensions. A transfer device is provided between the first and second housings including a flat plate adapted to pick up the tow from the conveyor of the first housing, and integral therewith, an enclosed chute adapted to deposit the tow on the conveyor of the second housing, the chute having height and width dimensions substantially the same as the maximum thickness and width dimensions of the bed of tow. The transfer chute is adapted to air seal the first housing from the second housing.

13 Claims, 9 Drawing Figures

ZONED HEAT TREATING APPARATUS

The present invention relates to improvements in a zoned heat treating apparatus, and in particular to improvements in a heat treating apparatus useful for the heat treating of tow. The present invention will be particularly described with respect to the heat setting of polyester or nylon tow, but it will be apparent to those skilled in the art that the present invention has other applications.

BACKGROUND OF THE PRESENT INVENTION

Polyester and nylon yarn are usually produced first by polymerization of the polyester or nylon followed by the production of monofilaments of the polyester or nylon. This is accomplished by subjecting the polyester or nylon to melting, and then extruding the melt through a large number of small nozzles. These nozzles are spaced closely together to form a bundle of the monofilaments, assembled together without twisting, this bundle forming what is known as polyester or nylon tow. Conventionally, the tow is then fed through a stretch line where it is lengthened by stretching, reducing the monofilament diameter and orienting the fiber molecules. The tow may be heat-set on the stretch line, and it is then crimped and fed to a dryer/heat-setter where it is dried and further heat-set. Alternatively, the tow may be first crimped and then fed to the dryer/-heat-setter. In the dryer/heat-setter, the tow is heated to a temperature as high as about 250° to 400° F., to set the crimp in the tow. The crimped tow is then cut into short lengths to form staple which is then twisted or spun by a user to produce yarn.

When the fiber tow leaves the dryer/heat-setter, it is at a high temperature, and must be cooled before cutting to short lengths, to avoid even partial removal of the crimp. Although cooling can be carried out by exposure of the tow to ambient temperature, it is more conventional to transmit the tow into an enclosed cooling zone, immediately following the dryer/heat-setting zone, where the tow is exposed to a forced air flow, at ambient temperature.

In the dryer/heat-set and cooling apparatus, the tow is usually conveyed through the apparatus on the surface of an elongated continuous conveyor extending through the apparatus. The tow is laid down on the conveyor in an undulating or zig-zag pattern so that it covers a defined surface of the conveyor. The problem is that the dryer/heat-set and cooling zones are at substantially different temperatures. The conveyor is composed of a large number of successive, transverse, relatively thin perforated metal plates, in addition to other components, providing a high surface-to-mass ratio. These plates are quickly heated to the high temperatures of the drying and heat-set zones, and then quickly cooled to the temperature in the cooling zone, on passage through the successive zones. Specifically, the conveyor is heated to a temperature in the range of about 250° to about 400° F. in the dryer and heat-set zone, and then is cooled in the cooling zone with a loss of a substantial portion of the retained heat in the cooling zone. The conveyor then has to be reheated as it passes back to the drying and heat-set zone, absorbing more heat, which is again lost as the conveyor moves into the cooling zone.

An obvious answer to this problem is to provide separate conveyors in the dryer/heat-set zone and cooling zone. However, the tow cannot simply be dumped from one conveyor to the other as could a granular product. The tow could become entangled with the conveyor plates, or conveyor hinges, as the conveyor plates are carried around an end sprocket of the conveyor, and start wrapping up on the conveyor. As serious a problem is entanglement of the tow with itself, in transfer from one conveyor to another, making it difficult to remove the tow at the delivery end of the apparatus. In this regard, the tow is lifted vertically from the conveyor at the delivery end. Initially, the tow is stacked vertically on the conveyor, and it is desirable to maintain this vertical orientation or stacking and to prevent the stack from falling forward in passage through the heat treating and cooling apparatus. Such forward fall of the stack means that the tow, at the delivery end, has to be removed from underneath the stack. In such case, self-entanglement becomes likely.

Also, in such a dumping operation between the drying/heat-set and cooling zones, air leakage losses will occur between the two zones with corresponding high heat losses. In high capacity units, where the dryer/heat-setting zone is operated at a temperature up to about 400° F., with the cooling zone being at ambient temperature, with different pressures in the two zones, the heat loss can be substantial.

BRIEF DESCRIPTION OF THE PRESENT INVENTION

These and other disadvantages are overcome in accordance with the concepts of the present invention by providing, in a heat treating apparatus having separate zones at different temperatures, useful in the heat treating of tow, a transfer means between said zones for the tow which includes an enclosed chute having height and width dimensions substantially the same as the maximum width and thickness dimensions of the bed of tow in said zones forming an air seal between the zones.

More specifically, the present invention resides in a heat treating apparatus having first and second elongated housing means substantially rectangular in cross-section and positioned end-to-end, preferably employing a common end wall. A first endless conveyor means is longitudinally positioned in the first housing and a second endless conveyor means is longitudinally positioned in the second housing. The first housing is maintained at a sufficiently elevated temperature to dry and then heat-set the polyester or nylon tow, and the second housing is maintained at substantially ambient temperature for cooling the tow. Means are provided to deposit a continuous length of tow on the first conveyor means upper run, at the inlet end of the first housing means, in an undulating pattern defining a substantially straight bed of tow having substantially uniform maximum thickness and width dimensions. The transfer means is positioned between the outlet end of the first housing and inlet end of the second housing, and includes a scray, in the form of an inclined flat plate, to pick up the tow from the first conveyor means, and integral therewith, an enclosed chute, leading to the second conveyor means, having height and width dimensions substantially the same as the maximum thickness and width dimensions of the bed of tow.

In an embodiment of the present invention, the tow is deposited on the first conveyor means upper run, of the first housing, by a pair of side-by-side oscillating feed chutes or plaiters to form parallel beds of tow. A single chute is provided, between the first and second housings, for the parallel beds of tow. Each side of the chute is provided with a hinged roof portion counterweighted or otherwise suspended to lightly rest on the tow. If a tow line is out of operation, the roof portion for that bed of tow drops to the floor of the transfer chute, air sealing the first housing from the second housing. As will be described in greater detail, each hinged roof portion is provided with upstanding sides designed to overlap an adjacent side of the other hinged roof portion, providing an impediment to cross-flow of air in the transfer chute.

DETAILED DESCRIPTION OF THE PRESENT INVENTION

The present invention and advantages thereof will become apparent upon consideration of the following specification, with reference to the accompanying drawings, in which.

Figure 1:
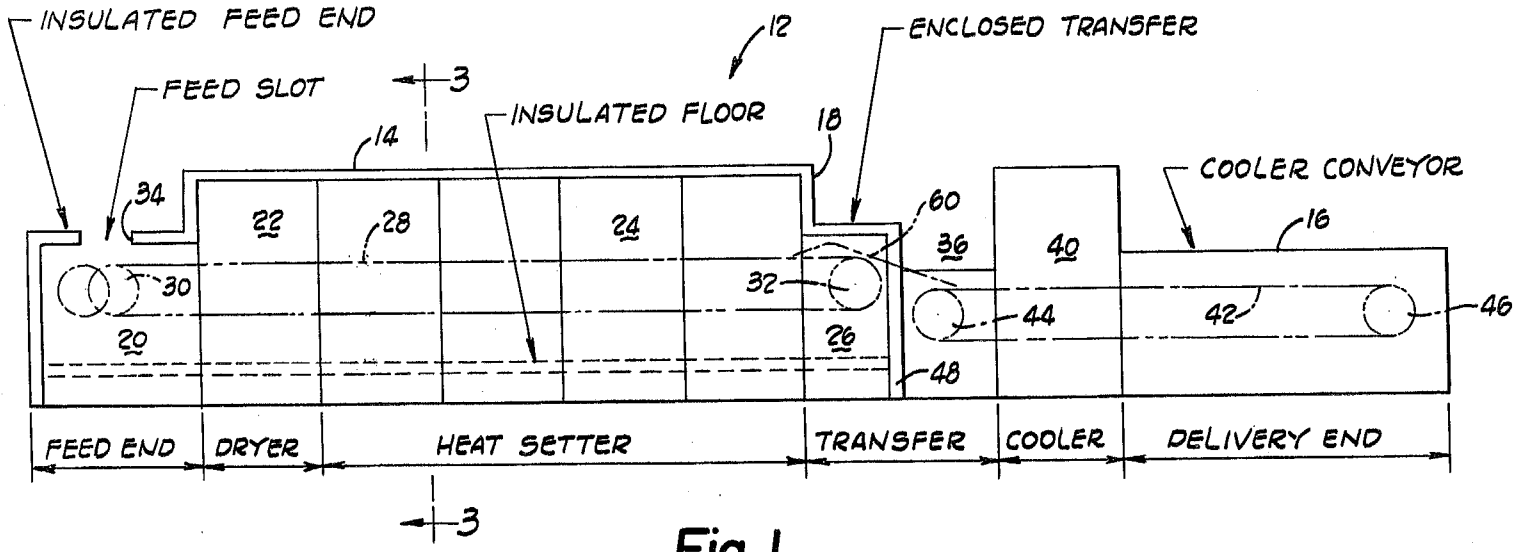
FIG. 1 is a diagrammatic partial section elevation view of a zoned heat treating apparatus in accordance with the concepts of the present invention.
Figure 2:
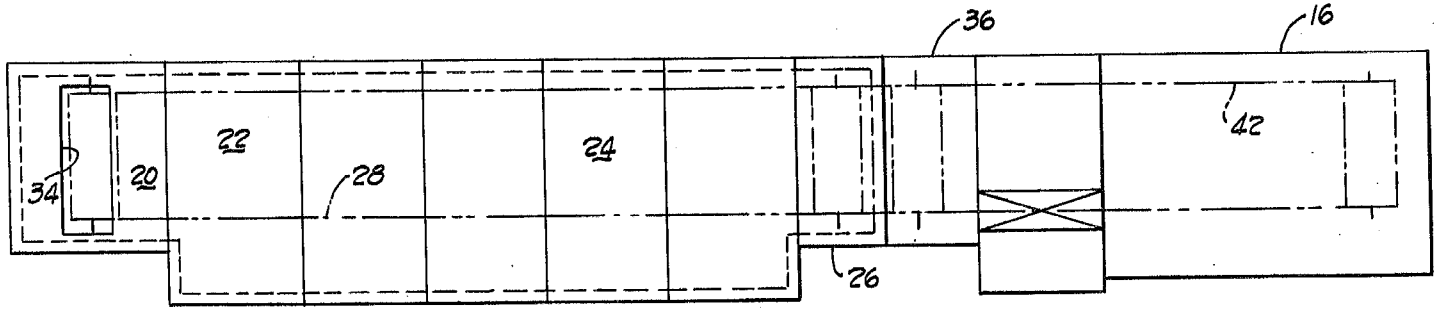
FIG. 2 is a plan view of the apparatus of FIG. 1.

Turning to the drawings, the heat treating apparatus 12 of the present invention comprises a first dryer/heat-set housing 14 which is generally elongated in shape and rectangular in cross-section, and end-to-end therewith, a second cooling housing 16, also elongated in configuration and generally rectangular in cross-section. The dryer/heat-set housing 14 is provided with insulated walls 18 to define a substantially fully enclosed chamber except for feed and discharge openings to be described. Essentially, the dryer/heat-set housing is divided longitudinally into a feed end 20, followed by a dryer section 22, and then a heat setting section 24 terminating in a discharge end or transfer section 26. In the dryer/heat-set housing, there is provided an endless conveyor 28, extending from the feed end 20 to the discharge end 26, the endless conveyor being rotatably movable on end sprockets 30 and 32, positioned in the feed and discharge ends, respectively.

Above sprocket 30, the dryer/heat-set housing is provided with a laterally extending slot 34 through which tow is fed to the endless conveyor 28, in a manner to be described.

Figure 3:
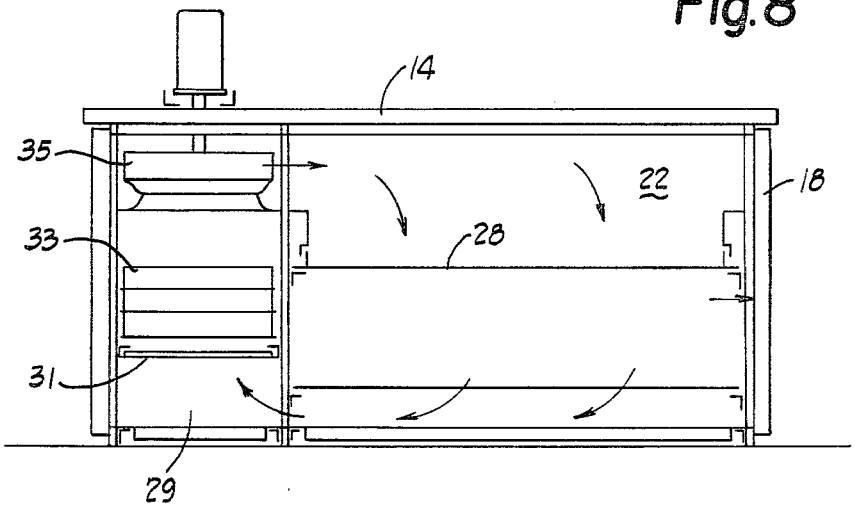
FIG. 3 is an enlarged section view taken along line 3—3 of FIG. 1.

Details of the air flow and heating system for the dryer are illustrated in FIG. 3. The air flow is downwardly through conveyor 28, into a plenum chamber 29 and upwardly through a filter screen 31 across steam heating coils 33. Circulation of the air through the plenum chamber 29 and across conveyor 28 is maintained by rotating fan 35. By means of the steam coils 33, the hot air in the dryer/heat-set housing is maintained at an air temperature of from about 250° to about 400° F. An alternative to steam coils would be a conventional gas burner, electric coils, or hot oil coils.

Figure 5:
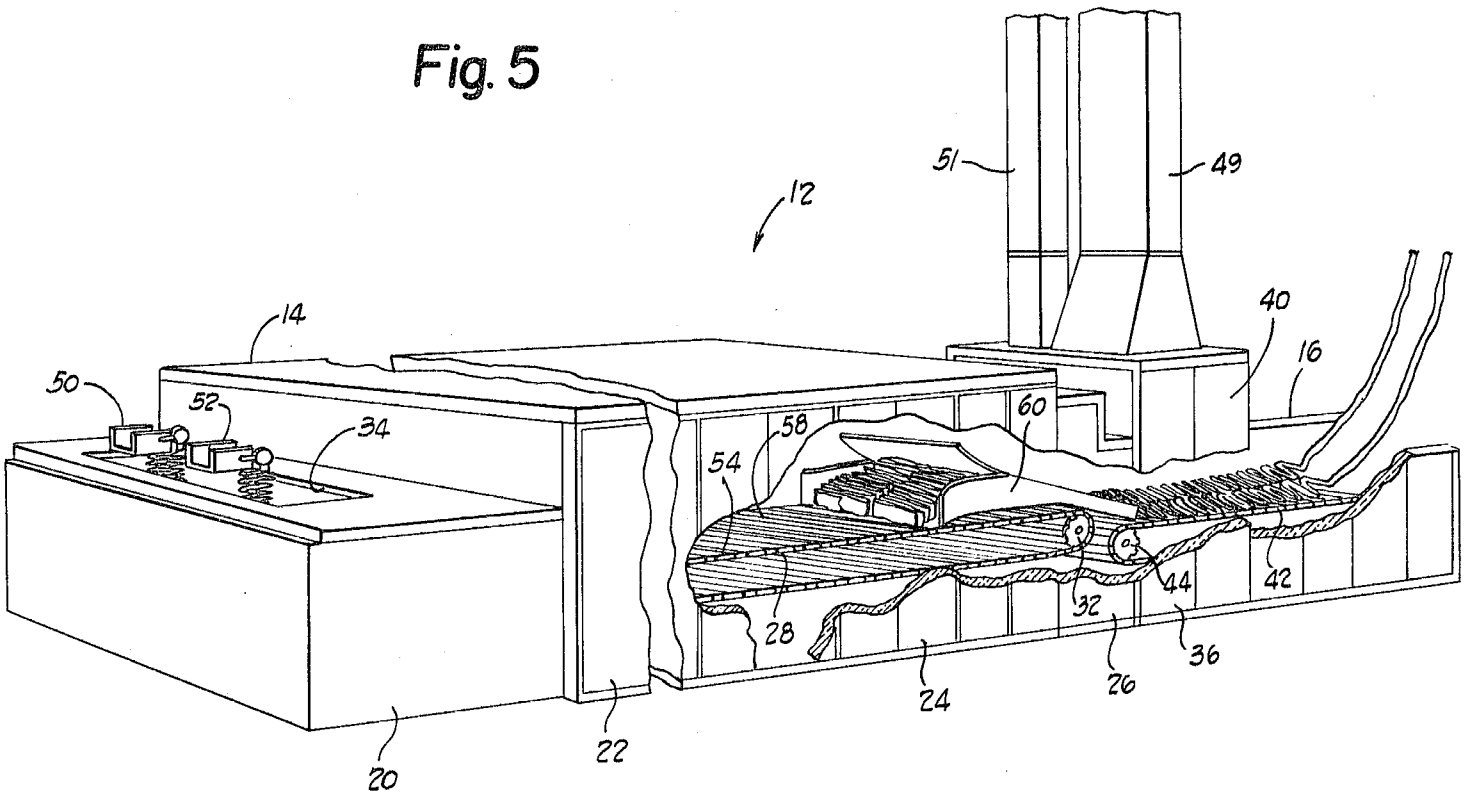
FIG. 5 is an enlarged perspective view illustrating the feed arrangement for plaiting tow onto a conveyor of the heat treating apparatus, and for removal of the tow at the discharge end of the apparatus.

Details of the cooling housing 16 are shown in FIGS. 1 and 5. Longitudinally, the housing comprises a transfer end 36, a discharge or delivery end 38 at the opposite end of the housing, and a cooling section 40 intermediate the transfer and discharge ends. Extending longitudinally through the cooling housing is an elongated conveyor 42, supported on end sprockets 44 and 46 at the transfer and discharge ends, respectively. In this embodiment of the present invention, the cooling housing shares a common end wall 48 (FIG. 1), at the transfer end of the cooling housing, common to the end wall of the discharge end or transfer section 26 of the dryer/heat-set housing. Means, not shown, in the cooling section 40 are provided for forced draft flow of ambient air, at ambient temperature, from outside the housing past the conveyor 42 and through the tow thereon to cool the same. Details of the cooling housing are similar to those for the dryer/heat-set housing, illustrated in FIG. 3, except that ambient air is drawn downwardly through main stack 49 (FIG. 5), and then to the side of the cooling zone and upwardly through exhaust stack 51 (FIG. 5), by a fan (similar to fan 35 of FIG. 3), not shown.

Details of the tow feed to the dryer/heat-set housing are illustrated in FIG. 5. In this embodiment of the present invention, the dryer/heat-set housing conveyor 28 has a width about twice the width of a bed of tow transmitted through the housing. A pair of feed chutes or plaiters 50 and 52 are positioned with discharge ends immediately above feed slot 34 of the dryer/heat-set housing. Each feed chute or plaiter is in the form of a polished sheet metal trough provided with means (not shown) adapted to oscillate the feed chute or plaiter back and forth along the slot (transverse to the longitudinal direction of the housing 14) to deposit the tow in two parallel undulating patterns on the endless conveyor 28 upper run. The two scanners or plaiters are moved in unison laying the tow on the conveyor in parallel side-by-side beds. Although the beds of tow define quite variable width and height dimensions, the maximum width and height dimensions of the tow remain substantially the same or uniform. In this regard, FIG. 5 shows how the tow is vertically stacked or laid on the conveyor. By vertically stacked, it is meant that a tow side rests on the conveyor with the opposte upper and lower faces of the tow extending vertically with respect to the conveyor.

Details of the conveyor 28 employed in the dryer/heat-set housing are also shown in FIG. 5. Each conveyor is composed of a pair of spaced-apart link chains adapted to travel around end sprockets 30 and 32 in the form of toothed wheels. A plurality of thin perforated successive plates extend between the conveyor chains laterally across the width of the housing. These plates are hinged together to provide a substantially continuous, flat, unbroken surface along the conveyor upper and lower runs, the hinging permitting angling of one plate with regard to an adjacent plate so as to negotiate the turn at the sprocket ends. As is conventional in the manufacture of conveyors of this type, a plurality of girts extend laterally beneath the plates 58 to provide support. It is essential that the conveyor plates be maintained substantially flat laterally across the dryer apparatus to allow pick-up by the transfer means to be described. Preferably the conveyor plates are made of polished stainless steel free of burrs, projections and other snags which might catch the polyester or nylon tow.

Figure 6:
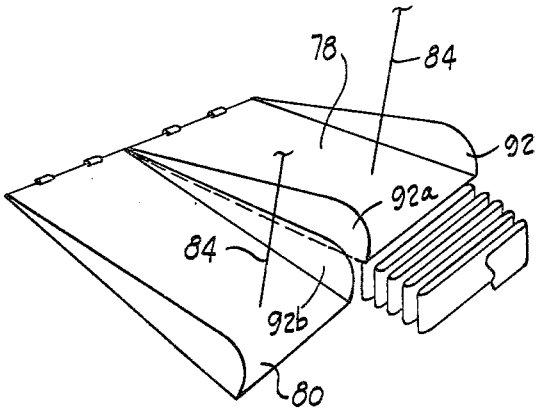
FIGS. 6, 7 and 8 are perspective, plan, and elevation views, respectively, illustrating details of the apparatus of FIG. 1 in accordance with the concepts of the present invention.
Figure 8:
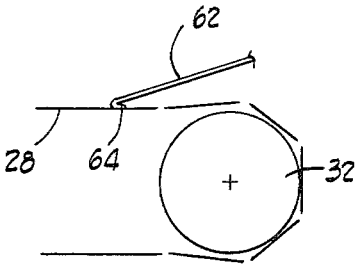
Figure 7:
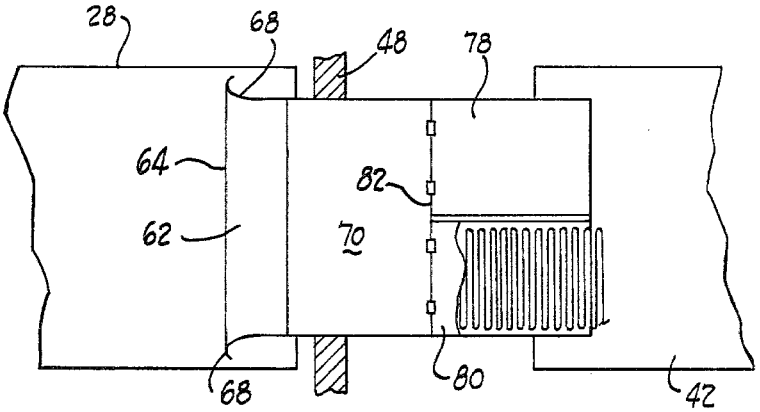
Figure 4:
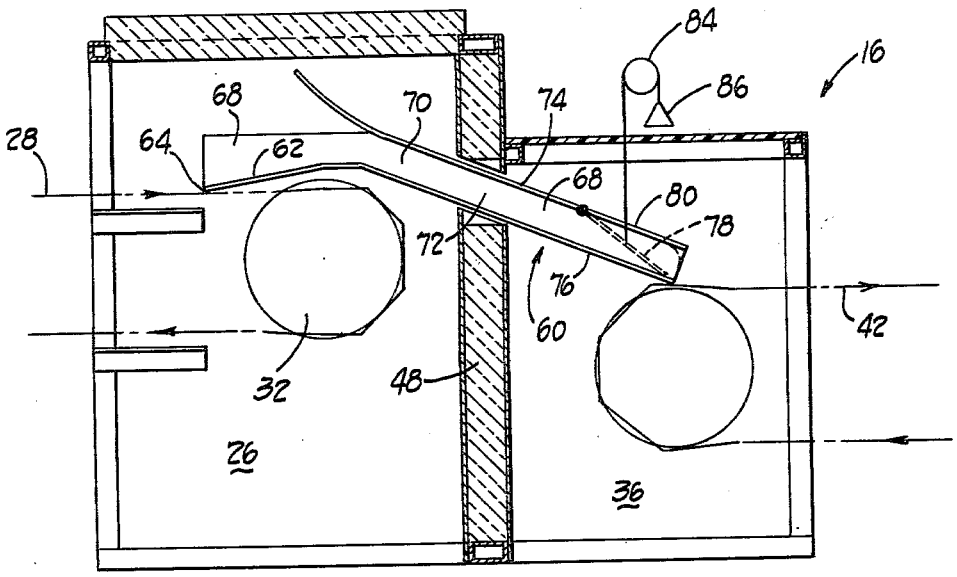
FIG. 4 is an enlarged section elevation view of a portion of the heat treating apparatus of FIG. 1, showing a transfer means in accordance with the concepts of the present invention.

Details of the transfer means 60 of the present invention are illustrated in FIGS. 4–8. In essence, the transfer means comprises a scray 62 (FIG. 4), in the form of an inclined flat plate having a free leading edge 64 bearing against the upper surface of endless conveyor 28. The point of contact of the scray 62 with the conveyor 28 is immediately prior to the area of rotation of the conveyor around end sprockets 32, and just before the local chordal action or affect caused by travel of the conveyor around the sprockets. As indicated in FIG. 8, the leading edge 64 of the scray is preferably smooth and rounded to avoid any snagging of the scray on the moving tow. The scray provides a solid surface for the tow to travel up and over the end of the conveyor, in the transfer section 26. As illustrated in FIG. 7, the scray is provided with leading flared sides 68 to guide the beds of tow smoothly onto the scray and to prevent snagging of the tow by the leading edges of the sides. Connected to the scray is an enclosed transfer chute 70 which extends downwardly through end wall 48 to the upper surface of the endless conveyor 42 in the cooling housing 16. As illustrated in FIG. 4, the transfer chute 70 is in sealing engagement with the common end wall 48 to prevent the flow of air between the dryer/heat-set housing and cooling housing. In this embodiment of the present invention, the conveyor 42 in the cooling housing is at a lower elevation than the conveyor 28 in the dryer/heat-set housing. The transfer chute 70 is generally rectangular in shape having sides 72, a roof 74 and a floor 76 (FIG. 4). All components of the transfer means are preferably of polished stainless steel free of burrs, projections and snags which would tend to catch the tow. The importance of the flatness of the conveyor plates of conveyor 28 is to maintain substantially continuous contact of the scray leading edge 64 with the conveyor, laterally across the width of the conveyor, and to avoid the passage of tow beneath the scray.

In the embodiment of the present invention illustrated in FIGS. 4–8, the transfer chute 70 is provided with a pair of hinged flaps 78 and 80, hinged to a free edge 82 of the transfer chute roof 74, pivotable downwardly into sealing contact with the transfer chute floor 76. Each of the hinged flaps 78 and 80 is counterbalanced with a pulley and counterweight means 84 and 86, schematically shown in FIG. 4. As alternatives, the flaps can be counterbalanced with air pistons or springs, as desired. Each hinged flap is provided with upstanding sides **92*a* and 92*b* overlapping slightly (as shown in FIG. 6) when one flap is in the up position and the other is in the down position. In this way, the hinged flaps provide a barrier against cross-flow of air within the transfer chute 70**.

Normally, the dimensions for the transfer chute will be just enough to accommodate the two beds of tow going from conveyor 28 to conveyor 42, from the dryer/heat-set housing to the cooling housing. In this regard, the maximum width and depth dimensions for the tow will remain substantially uniform. The purpose of the arrangement illustrated in FIG. 6 is that, if there is an interruption of tow in either one of the beds of tow on the conveyor 28, the hinged flap for that bed will drop downwardly to the floor of the transfer chute sealing the chute. The counterweight means 84, 86 prevents the hinged flaps from placing excessive weight on the beds of tow.

Preferably the drive means for the conveyor 42 in the cooling section is variable in speed so that it can be run slower than the conveyor 28 in the dryer/heat-set housing. This allows some back resistance of tow in the transfer chute 70, causing the tow to bunch up slightly in the transfer chute providing a better air seal in the chute.

A principal advantage of the transfer chute of the present invention is that it establishes the same vertical stacking of the tow on the cooling section conveyor 42 as was established on the dryer/heat-set conveyor 28. This permits the tow to be lifted vertically from the conveyor at the discharge end 38 of the cooling section without the danger of self-entanglement of the tow, as shown in FIG. 5.

Figure 9:
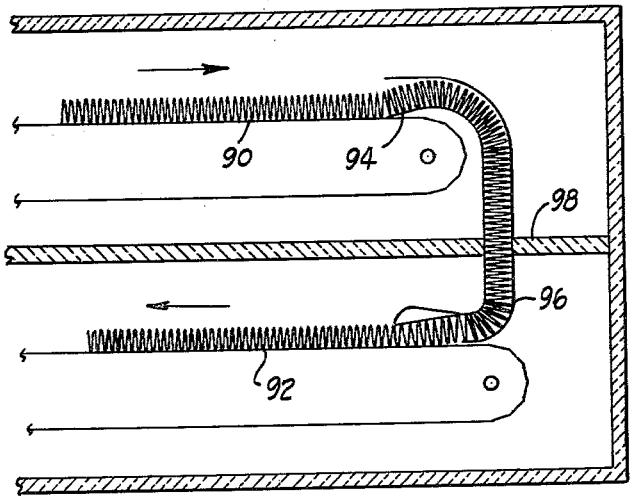
FIG. 9 is a section elevation view illustrating an embodiment of the present invention.

An alternative embodiment of the present invention is illustrated in FIG. 9. Conventionally, the drying and heat setting of the tow is carried out in a single elongated dryer/heat-set housing having a single continuous conveyor therein. For very extended units, it may be desirable to provide a double-decked conveyor arrangement within a single housing, illustrated as conveyors 90 and 92, allowing shortening of the housing length. The tow is deposited upon the upper conveyor 90, in the same undulating pattern as in the embodiment of FIG. 1, passing first through a dryer section and into a heat treating section, as is conventional. The tow is then transferred to a lower conveyor, reversing in direction in the housing and going through a second heat setting section to a discharge end. In order to transfer the tow from the upper conveyor to the lower conveyor, there is provided a scray 94, similar to that of the embodiment of FIG. 1, except that it is curved at its lower end in a reverse direction in the form of a J box 96. The tow plaits are laid down on the upper conveyor in an undulating pattern, as with the embodiment of FIG. 1. There may be some overlap of a rear plait over a plait immediately in front of the rear plait. In the J box, the plaits are automatically inverted so that they lay down on the lower conveyor 92 with a leading plait slightly overlapping and resting on a plait immediately behind it. In this way, the plaits can be removed from the lower conveyor without self-entanglement at the discharge end of the apparatus, as with the embodiment of FIG. 1. In both this embodiment and the embodiment of FIG. 1, this is important in the process of making crimped set tow, to avoid destroying the set.

At the same time, it is evident that the J box arrangement for the transfer chute of FIG. 9 provides a means for sealing the upper part of the housing shown from the lower part. In the embodiment illustrated, an intermediate wall 98 between the upper and lower portions of the housing is penetrated by the J box 96. The wall 98 and J box 96 preferably are in sealing engagement with each other.

In both of the embodiments of FIGS. 1 and 9, the receiving conveyor is at a lower elevation than the conveyor upstream of the transfer means of the present invention. The difference in elevation is sufficient for the tow to pass through the transfer means by gravity flow. It is possible to employ the transfer chute of the present invention with spaced conveyors at the same elevation. In such case, there would have to be provided means to push the tow along. This could be simply frictional engagement between the upstream conveyor and the tow.

What is claimed is:

1. Apparatus for the heat treatment of tow comprising a housing means;

first and second conveyor means in said housing means, each conveyor means comprising feed and discharge ends;

means to deposit said tow on the feed end of said first conveyor means in an undulating pattern defining at least one substantially straight unbroken bed of tow having substantially uniform maximum thickness and width dimensions;

means to drive said first conveyor means to advance the tow from the conveyor means feed end to the conveyor means discharge end;

means to advance the second conveyor means, the feed end of the second conveyor means being adjacent the discharge end of the first conveyor means; and transfer means to transfer the tow from the first conveyor means discharge end to the second conveyor means feed end including a generally flat plate to pick up the tow from the first conveyor means, and integral therewith, a chute means comprising a roof, floor and sides to deposit the tow from said flat plate onto the second conveyor means feed end, said chute means having height and width dimensions substantially the same as the thickness and width dimensions of the bed of tow.

2. The apparatus of claim 1 wherein said tow is deposited on the first conveyor means with successive plaits in a generally vertically stacked orientation;

the first conveyor means being at a higher elevation than the second conveyor means facilitating gravity flow of tow in the chute means.

3. The apparatus of claim 2 wherein said tow is polyester or nylon tow.

4. The apparatus of claim 1 wherein said tow is deposited on the first conveyor means with successive plaits slightly overlapping previous plaits;

said transfer means being in the form of a J box adapted to invert the tow deposited on the second conveyor means so that successive plaits slightly underlie previous plaits.

5. A heat treating apparatus particularly useful for heat treating tow comprising first and second elongated housing means positioned end-to-end;

first and second conveyor means longitudinally positioned in each of said housing means, respectively;

means maintaining said housing means at different temperatures;

means to deposit a continuous length of tow on the first conveyor means in an undulating pattern to define a substantially straight bed of tow on the first conveyor means having substantially uniform maximum thickness and width dimensions;

transfer means between the first and second housing means including a generally flat plate adapted to pick up the tow from the first conveyor means, and integral therewith, an enclosed chute which has height and width dimensions substantially the same as the thickness and width dimensions of the bed of tow adapted to deposit said tow on the second conveyor means;

said transfer means air sealing the first housing means from the second housing means.

6. The apparatus of claim 5 wherein said conveyor means are at different elevations, with the second conveyor means being at a lower elevation than the first conveyor means.

7. The apparatus of claim 6 wherein said tow is polyester or nylon tow, said first housing means being at a sufficiently elevated temperature to dry and heat-set the tow, the second housing means being at ambient temperature.

8. The apparatus of claim 5 including means to deposit two strands of tow, in an undulating pattern, in parallel beds on said first conveyor means, in side-by-side relationship, said transfer means chute including a pair of side-by-side hinged flap means adapted to ride on the upper surface of the beds of tow and to move to a closed position in said chute when the flow of one or the other of said beds of tow therein is interrupted.

9. The apparatus of claim 6 wherein said flap means is counterweighted, each of said flap means comprising upstanding sides adapted to overlap when one or the other of the flap means is in a closed position to prevent a cross-flow of air in said chute when the flow of one or the other of said beds of tow is interrupted.

10. Heat treating apparatus particularly useful for heat setting and cooling of polyester or nylon tow comprising first and second elongated housing means substantially rectangular in cross-section and positioned end-to-end;

opposite inlet and outlet ends for each of said housing means;

a first endless conveyor means longitudinally positioned in said first housing means and a second endless conveyor means longitudinally positioned in said second housing means, each of said conveyor means having a substantially horizontal upper run, said first conveyor means being at a higher elevation than the second conveyor means;

means maintaining said housing means at different temperatures;

means to deposit a pair of continuous lengths of tow on said first conveyor means upper run at the inlet end of said first housing means in undulating patterns defining a pair of substantially straight unbroken beds of tow having substantially uniform maximum thickness and width dimensions;

transfer means between the outlet end of the first housing means and inlet end of the second housing means including a generally flat plate adapted to pick up the beds of tow from the first conveyor means, and integral therewith, an enclosed chute means comprising a roof, floor and sides to deposit the beds of tow from the flat plate means onto the second conveyor means, said chute means having height and width dimensions substantially the same as the maximum thickness and width dimensions of the beds of tow;

said first and second housing means sharing a common end wall;

said transfer means air sealing the first housing means from the second housing means.

11. The apparatus of claim 10 wherein said chute means comprises a pair of side-by-side hinged flap means hinged to the transfer chute roof adapted to ride on the upper surfaces of the beds of tow and to move to a closed position against the transfer chute floor when the flow of one or the other of the beds of tow is interrupted, each of said flap means comprising upstanding sides adapted to overlap when one or the other of the flap means is in a closed position, to prevent a cross-flow of air in said chute means.

12. The apparatus according to claim 11 wherein said first housing is at a sufficiently elevated temperature to heat-set the tow, said second housing means being at ambient temperature.

13. A heat treating apparatus particularly useful for heat treating tow comprising housing means;

first and second conveyor means in said housing means;

means for maintaining a different environment around each of said conveyor means;

means to deposit a continuous length of tow on the first conveyor means in an undulating pattern to define a substantially straight bed of tow on the first conveyor means having substantially uniform maximum thickness and width dimensions;

said means for maintaining a different environment around said conveyor means including a transfer means between the first and second conveyor means adapted to pick up the tow from the first conveyor means and to deposit said tow on the second conveyor means;

said transfer means including chute means having approximately the same dimensions as said bed of tow air sealing the first conveyor means from the second conveyor means.

* * * * *